US008974553B2

(12) United States Patent
Ried

(10) Patent No.: US 8,974,553 B2
(45) Date of Patent: Mar. 10, 2015

(54) MISCIBLE DIESEL FUEL ETHANOL COMPOSITION

(71) Applicant: Joseph Ried, Fayetteville, TN (US)

(72) Inventor: Joseph Ried, Fayetteville, TN (US)

( * ) Notice: Subject to any disclaimer, the term of this patent is extended or adjusted under 35 U.S.C. 154(b) by 49 days.

(21) Appl. No.: 13/853,093

(22) Filed: Mar. 29, 2013

(65) Prior Publication Data

US 2013/0255141 A1 Oct. 3, 2013

Related U.S. Application Data

(60) Provisional application No. 61/617,065, filed on Mar. 29, 2012.

(51) Int. Cl.

| | |
|---|---|
| ***C10L 1/18*** | (2006.01) |
| ***C10L 1/182*** | (2006.01) |
| ***C10L 1/02*** | (2006.01) |
| ***C10L 1/08*** | (2006.01) |

(52) U.S. Cl.
CPC ..... *C10L 1/1824* (2013.01); *C10L 1/026* (2013.01); *C10L 1/08* (2013.01)
USPC ..... 44/451; 44/452

(58) Field of Classification Search
CPC ..... C10L 1/08; C10L 1/1824; C10L 1/026
USPC ..... 44/451, 452
See application file for complete search history.

(56) References Cited

U.S. PATENT DOCUMENTS

| | | | | |
|---|---|---|---|---|
| 1,471,566 | A * | 10/1923 | Murphy | 44/438 |
| 4,308,106 | A | 12/1981 | Mannfeld | |
| 4,451,265 | A | 5/1984 | Schwab' | |
| 4,539,014 | A | 9/1985 | Sweeney | |
| 4,585,461 | A | 4/1986 | Gorman | |
| 4,647,290 | A | 3/1987 | Reid | |
| 4,648,885 | A | 3/1987 | Reid | |
| 4,867,754 | A | 9/1989 | Reid | |
| 4,968,320 | A | 11/1990 | Genova et al. | |
| 5,114,436 | A | 5/1992 | Reid | |
| 6,017,369 | A | 1/2000 | Ahmed | |
| 6,190,427 | B1 | 2/2001 | Ahmed | |
| 6,306,184 | B2 | 10/2001 | Ahmed | |
| 7,172,635 | B2 | 2/2007 | Bongardt et al. | |
| 7,311,739 | B2 | 12/2007 | Bongart et al. | |
| 2004/0060226 | A1 | 4/2004 | Bongart et al. | |
| 2010/0242347 | A1 | 9/2010 | Eberhard | |

FOREIGN PATENT DOCUMENTS

| | | | |
|---|---|---|---|
| CN | 1155000 | A | 7/1997 |
| CN | 1523083 | A | 8/2004 |
| EP | 0319059 | B1 | 6/1989 |
| EP | 1130081 | A1 | 9/2001 |
| EP | 1227143 | B1 | 7/2002 |
| EP | 1334171 | B1 | 8/2003 |
| EP | 1334171 | B8 | 8/2006 |
| PL | 385065 | A1 | 7/2004 |
| RU | 2230775 | C1 | 6/2004 |
| WO | WO0162877 | A1 | 8/2001 |
| WO | WO0238707 | A2 | 5/2002 |
| WO | WO0238709 | A2 | 5/2002 |
| WO | WO02088280 | A2 | 11/2002 |
| WO | WO2006086936 | A1 | 8/2006 |

OTHER PUBLICATIONS

Aventine Renewable Energy, Inc., Fuel-Grade Ethanol Specifications, May 15, 2009, Pekin, Il USA.

Blume, Chap 25 How Diesel Engines Can Run on Alcohol, p. 449ff, in Alcohol Can Be a Gas!, Jan. 1, 2007 by International Institute for Ecological Agriculture.

Boruff et al., Evaluation of Diesel Fuel—Ethanol Microemulsions; Transactions of the ASAE, p. 47, 1982.

Chemical and Engineering News, p. 29, Dec. 15, 1980.

Golubkov et al., Alcohol-based diesel fuel for conventional engines—it is a reality; http://www.eri.ucr.edu/ISAFXVCD/ISAFXVAF/AIBAFR.pdf, accessed Jul. 3, 2013.

Hanson et al., Ethanol-diesel fuel blends—a review; Bioresource Technology, 96 (2005) 277-285.

International Fuel Quality Center, Hart Downstream Energy Services; Setting a quality standard for Fuel Ethanol, DEH Ethanol Standard18/2004 Report.

Isarachewa et al., The Effect of an Oxygenated Additive on . . . Diesel-Ethanol Blends; www.eppo.go.th/encon/energyresearch/PDF/thanyathon.pdf accessed Jul. 3, 2013.

Jalmby et al., The Swedish process for introducting bioethanol on the market; BEST; May 2007; BioFuel Region, c/o Esam AB, Storgatan 35, SE-903 25 UMEA, Sweden.

Karosmanoglu et al., Effects of a new blending agent on ethanol-gasoline fuels; Energy and Fuels, 1986, (10) 816-820.

Korotny, Water phase separation in oxygenated gasoline—corrected version of Kevin Krause memo; www.epa.gov/oms/res/fuels/rfg/waterphs.pdf; accessed Jul. 3, 2013.

(Continued)

*Primary Examiner* — Cephia D Toomer
(74) *Attorney, Agent, or Firm* — David W. Ladner; Ladner Patent Management LLC

(57) ABSTRACT

The invention relates to a fuel composition comprising diesel fuel, a fusel oil distillate and ethanol, and to a method of its preparation by splash blending.

17 Claims, No Drawings

(56) References Cited

OTHER PUBLICATIONS

Kucuk et al., Potential utilization of fusel oil; a kinetic approach for production of fusel oil esters through chemical reaction; Turk J. Chem., 22 (1998) 289-300.
Kwanchareon et al., Solubility of a diesel-biodiesel-ethanol blend, its fuel properties and its emission characteristics from diesel engine; Fuel, 86(10) 1053-1061 (2007).
Lapuerta et al., Effect of ethanol on blending stability and diesel engine emissions; Energy Fuels, 2009, 23, 4343-4354.
Lee et al., Liquid-liquid equilibria for ternary mixtures containing vegetable oils, methanol and cosolvents; The Open Thermodynamics Journal, 2010, 4, 122-128.
Lei et al., A novel emulsifier for ethanol-diesel blends and its effect on performance emissions of diesel engine; Fuel, 93, 2012, 305-311.
Letcher, Ternary liquid-liquid phase diagrams for diesel fuel blends, Part 1; South African Journal of Science, 76, 130-132, Mar. 1980.
Letcher, Diesel blends for diesel engines; South African Journal of Science, 79, Jan. 4-7, 1983.
McCormick et al., Technical barriers to the use of ethanol in diesel fuel; Advanced Petroleum Based Fuels Progam and Renewable Diesel Program; NREL/MP-540-32674, Nov. 1974.
NTIS, Gasohol, order #PB80-105885, p. 10, 1979.
Ommi et al., Emission and properties characteristics using additive-ethanol-diesel fuel blends on a diesel engine; Ann. of Faculty Hunedoara, J. of Eng., VII, 2, 2009.
Peeples, An introduction to E diesel(R): commercialization and standardization; Alternative Diesel Symposium, Cal. Air Res. Board and Cal. Energy Comm., Aug. 19, 2003.
Pidol et al., Ethanol-biodiesel-diesel fuel blends: performances and emissions in conventional diesel and advanced low temperature combustions; Fuel, 93, 329-338, 2012.
Pirozfar et al., Effect of additive-ethanol-diesel blend fuel on physico chemical properties and emission; Fuel and Combustion, vol. 1, No. 2, Fall 2008.
Purcell, eDiesel—barriers and benefits, EPA SRIVE Programme, 2005-ET-DS-18-M3, http://erc.epa.ie/safer/reports accessed Jul. 3, 2013.
Sathiyagnanam et al., Effects of diesel particulate trap . . . on emission characteristics of a diesel engine; Fuel, 87, 2281-2285, 2008.
Selvan et al., Stability of diesohol using biodiesel as additive and its performance and emission characteristics . . . ; Int. J of Appl. Eng. Res., Sep. 1, 2009.
Waterland et al., Safety and perfomance assessment of ethanol/diesel blends (E-diesel), NREL/SR-540-34817, Sep. 2003.
Zhang et al., Preparation of ethanol-diesel fuel blends and exhausts emission characteristics in diesel engine; Huan Jing Ke Xue, Jul. 24(4)1-6, 2003. (abstract only).
Zhang et al., Preparation and emission characteristics of ethanol-diesel fuel blends; J. Environ. Sci. (China)16 (5):793-6, 2004. (abstract only).

* cited by examiner

MISCIBLE DIESEL FUEL ETHANOL COMPOSITION

CROSS-REFERENCE TO RELATED APPLICATIONS

This Application claims the benefit of U.S. Provisional Application No. 61/617,065, filed on Mar. 29, 2012, which is incorporated herein by reference in its entirety.

FIELD OF THE INVENTION

This application relates to a diesel fuel and ethanol composition containing a fusel oil distillate which is useful as fuel in engines.

BACKGROUND OF THE INVENTION

Internal combustion engines are the main source of power for a wide variety of vehicles throughout the world, and include passenger cars, buses, trucks, farm tractors and other equipment, construction equipment, as well as portable equipment such as electrical generators, air compressors and the like. While the engines in most passenger vehicles are powered by gasoline (a.k.a. "petrol"), engines in most commercial vehicles and equipment use conventional diesel fuel. Gasoline has gained popularity because gasoline engines typically produce less harmful emissions, such as soot and unburned hydrocarbons, and are more easily started in colder weather. Diesel engines, which typically use No. 1 or No. 2 diesel fuel, tend to be louder, produce more harmful emissions, and are more difficult to start in cold weather. However, the energy contained in a single gallon of diesel fuel is approximately 25,000 Btus greater than that found in a gallon of gasoline, thus diesel fuel is more efficient.

In recent years, an effort to reduce the use of fossil fuels has prompted widespread use of gasoline/ethanol mixtures, in which approximately 10-20% ethanol is added to gasoline. However, similar hybrid fuel mixtures containing diesel fuel and ethanol have not come into widespread use, despite the disclosure of various methods to form such blends. The ethanol used in gasoline/ethanol blends is typically produced from renewable sources such as by fermentation of plant material, notably corn. It is estimated that about 30% of the transportation fuel used in the United States is diesel fuel. This includes both petroleum-based diesel fuel, and to a much lesser extent, vegetable or animal fat based diesel fuel ("biodiesel"). It is estimated that widespread use of diesel fuel blended with 20% ethanol would result in a decrease in fossil fuel use for transportation purposes of up to 6%.

The demand for fuel ethanol has resulted in an increase in the acreage devoted to the production of grain from which the ethanol is produced. Further gains in production have resulted from increased corn production per acre, and increased ethanol production per kernel. In addition, increases in food production in other nations, such as the Russian Federation, are projected, and could free up starch crops for additional ethanol production. Such factors would allow the blending of ethanol with diesel to become more economically feasible and practical. As the growth in the use of fully electric vehicles, hybrid gasoline burning vehicles, and more fuel efficient gasoline burning vehicles takes place, more ethanol may become available for use in diesel engines. Diesel engines, in contrast, are not as amenable to replacement by electric engines because of their widespread use in heavier vehicles that require more power. Thus a changeover from diesel to electric powered engines is expected to require a significantly longer time, and the demand for economical diesel fuel will continue.

While there has been widespread acceptance of gasoline/ethanol blended fuels, diesel fuel/ethanol blends have achieved limited success. This is due in large part to the technical problem associated with the different physical and chemical properties of ethanol, gasoline and diesel fuel. Such differences account for the different approaches used for the formulation of each of these blended fuels.

Gasoline typically is a lower boiling blend of hydrocarbons, straight and branched chain, as well as unsaturated and aromatic hydrocarbons, which are optimized and blended with additives to provide an octane rating of 97 or higher. Greater unsaturation and aromatic content tends to increase the octane rating.

Diesel fuels are typically higher boiling paraffinic hydrocarbons, substantially free of lower vapor pressure species such as aromatic and unsaturated hydrocarbons, and are optimized for cetane rating of about 40. Cetane rating is a metric used to estimate the performance characteristics of diesel fuel. This number derives from the performance characteristics of a specific mixture of un-branched open-chain alkane molecules (approximately 10 carbons total) that ignite very easily under compression, which are assigned a cetane number of 100; in contrast, alpha-methyl naphthalene (an aromatic hydrocarbon) is assigned a cetane number of 0. In order for diesel fuel to achieve desirable properties, i.e., a desirable cetane number, additives such as alkyl nitrates (principally 2-ethyl hexyl nitrate) are used. A cetane number of 30 or more is required for suitable diesel fuels.

Commercial ethanol is purified by distillation, forming an azeotrope with water (about 95:5 v/v). In the production of fuel ethanol, the bulk of the water is removed using 3 Å molecular sieve drying agents, providing a final water content of 1% v/v max. The cetane number of ethanol is about 8. Fuel ethanol contains 1.96-5.0% denaturant, i.e., a substance is added to the ethanol to make it unsuitable for human consumption. Gasoline itself is a denaturant, and other common denaturing additives include (but are not limited to) materials such as methanol, benzene, toluene, isopropanol, methyl ethyl ketone, methyl isobutyl ketone, pyridine, diethyl phthalate, and naphtha. In some countries, denatured alcohol must be colored blue or purple using an aniline dye, in order to distinguish it from consumption-grade ethanol.

Thus the properties of gasoline and diesel fuel are quite different, each having been optimized to provide properties (i.e., octane and cetane ratings) which are often inversely related, in order to satisfy the requirements of the engines in which they are used. Specifically, a gasoline/ethanol blend and a diesel fuel/ethanol blend, each of which contain the same volume of ethanol and the same volume of contaminating water behave quite differently. It has been reported that anhydrous (dry) alcohol is miscible with diesel fuel, particularly biodiesel in all proportions, at least at ambient temperatures (Blume 1983, 2003). However when operating at reduced temperatures, a diesel/ethanol blend will undergo phase separation at a much higher temperature than a similar gasoline/ethanol blend. In addition, a gasoline/ethanol blend and a diesel fuel/ethanol blend are affected differently by the amount of water present in the blend. For example, a blend consisting of 90% gasoline by volume and 10% anhydrous ethanol by volume can separate at 0° C. if it becomes contaminated with greater than 0.4% by volume of water. A blend consisting of 90% diesel fuel by volume and 10% anhydrous ethanol by volume, however, can separate at 0° C., if it is contaminated with just 0.05% water by volume.

Thus a major drawback in ethanol-diesel fuel blends is that ethanol is immiscible in diesel over a wider range of temperatures and water content, than corresponding ethanol-gasoline blends, resulting in fuel instability due to phase separation (Kwanchareon 2006). Phase separation of ethanol from the diesel/ethanol blend, allowing introduction of ethanol itself into the engine, can cause damage to diesel engines as they are currently designed. It is accepted that attempting to use ethanol itself in a diesel engine is a problem that is "technically very complex . . . " and requires " . . . important modifications on the engine hardware in order to overcome the weak auto ignition property of ethanol." [L. Pidol, et al., *Fuel,* 85, (5-6), March-April 2006, pp 815-822]

Hence, a more technically feasible solution to the use of ethanol in diesel engines is to provide for a blending agent that prevents such phase separation of diesel/ethanol mixtures at reduced operating temperatures.

Many of the additives and blending agents used to form ethanol/gasoline blends are not particularly useful or compatible with those used to form ethanol/diesel fuel blends. Often this is because the addition of ethanol enhances the octane rating of gasoline, but decreases the cetane number of diesel fuel. "The very thing that makes alcohol an ideal fuel for spark-ignited engines—its high resistance to pinging, due to its high octane rating—works against its easy use in diesel engines." (Blume, Alcohol can be a gas! Book 4, Chap 25 p. 450). Hansen et al. have published a review of agents used to form ethanol-diesel fuel blends (Bioresource Technology 96, p 277-285 (2005)). Such agents are either miscible directly (co-solvents) and can be "splash blended", or are emulsifying agents which require heating to achieve blending.

For example, U.S. Pat. Nos. 6,190,427, 6,017,369, 7,311,739, and 7,172,635, describe compositions of diesel fuel and ethanol further comprising a mixture of ethoxylated fatty alcohols and ethanolamides.

U.S. Pat. No. 4,968,320 describes a blend comprising diesel fuel, crude fusel oil, a surfactant and water. The surfactants used are, for example, an alkali metal salt of an alkylbenzenesulfonic acid or of an unsaturated higher fatty acid. The fusel oil may contain some ethanol, in addition to other alcohols.

U.S. Pat. No. 4,451,265 describes a blended fuel comprising a diesel fuel, a lower ($C_1$-$C_3$) alcohol, water and a surfactant system derived from the reaction product of N,N-dimethyl amine and a long-chain fatty acid substance.

McCormick and Parish, "Advanced Petroleum Base Fuels Program and Renewable Diesel Program," NREL/MP-540-32674, November 2001, review the state of the art for ethanol in diesel fuel (E-Diesel). The report describes the physical properties of 15% ethanol/diesel blends that contain emulsifiers as having lower flash points. This change in property of the fuel, results in a change from a Class II liquid to a Class I liquid.

L. R. Waterland et al, "Safety and Performance Assessment of Ethanol/Diesel Blends (E-Diesel), NREL/SR-540-34817, September 2003, further review the safety and performance aspects of ethanol/diesel blends, citing five additive (emulsifier) vendors: Pure Energy, a blend of alkyl esters of fatty acids, fatty acid alcohols and a polymer; O2 Diesel (formerly AAE Technologies) alkanolamides; Akzo Nobel with a propriety agent called Beraid ED10; Lubrizol and GE Betz, with a phosphite-based additive.

A report (DEH Ethanol Standard 18/2004, International Fuel Quality Center, 2004) describes ethanol/diesel blends as a test fuel in the US, Thailand and Sweden. It refers to a SCANIA additive identified as Etamax D, referenced in US patent application 2000242347, which describes a diesel fuel composition comprising about 60 to about 95% (v/v) ethanol, and up to about 20% (v/v) of a linear dialkyl ether with a chain length of about 10 to about 40, as well as mixtures thereof, and 0 to about 30% (v/v) combustion accelerator. Described combustion accelerators include rapeseed, palm oil or soya oil methyl esters.

Lacking an emulsifying agent (e.g., a surfactant) or a blending agent, the miscibility of ethanol with either diesel fuel or gasoline is essential for its practical use in blended fuel. Miscibility must also be maintained at temperatures where vehicles are normally operated, including from well below freezing (e.g., −15° F.) to as high as 110° F. At low temperatures, waxing or gelling of unblended diesel fuel occurs. Kerosene can be added to solve the problem, but the addition of ethanol generally does not.

Fusel oil or more accurately, crude or unrefined fusel oil is broad term used to describe a byproduct of the fermentation process. According to the Encyclopedia Britannica, it is a mixture of volatile, oily liquids produced in small amounts during alcoholic fermentation. Typically fusel oil contains 60-70 percent amyl alcohols, smaller amounts of n-propyl and isobutyl alcohols, and traces of other components including ethanol. The amount of ethanol may depend on the skill, equipment and techniques of the distiller. Fusel oils alcohols are apparently produced during fermentation from amino acids. Before industrial production of synthetic amyl alcohols began in the 1920s, fusel oil was the only commercial source of these compounds, which are major ingredients of lacquer solvents. In industrial alcohol plants, fusel oil and ethyl alcohol are separated from the fermented liquors via distillation. The fusel oil fraction boils higher than the ethanol fraction. U.S. Pat. No. 4,585,461 further describes fusel oil as a volatile, poisonous mixture of isoamyl, isobutyl, and ethyl alcohols produced as by-products in alcoholic fermentation, of starches, grains, or fruits to produce ethyl alcohol. For example; fusel oil is a by-product in the process of aging wine and beer. As ethanol manufacturers distill the fermented mixture, the high boiling fraction is fusel oil. It is often referred to as the tailings. Fusel oil is foul-smelling and generally considered a nuisance waste material. Proper disposal of fusel oil is required because of its toxic nature, having among its constituents a teratogen and suspected carcinogen. Fusel oils are primarily used as boiler fuel. However, its disadvantages as boiler fuel include (1) 5-18% water content which severely hinders its burning and (2) an oxygen content which reduces its BTU content substantially below gasoline, diesel fuel, or number 4 fuel oil.

The chemical composition of fusel oil is not precisely defined. It depends on such factors as the raw material used for the fermentation (e.g., corn, sugar/molasses, rice, etc.). At least 50 different compounds have been identified in molasses-based fusel oil using gas-liquid chromatography, the major components being 2-methyl-1-butanol and 3-methyl-1-butanol (Karaosmanoglu et al., *Energy & Fuels,* 1996, 10, 816-820). It was also found to contain about 8.6% water (v/v). It is usually supplied in either a crude or a refined grade. The crude grade is reported (U.S. Pat. No. 4,968,320) to be 38% isoamyl alcohol, 25% isobutyl alcohol, 4.5% isopropyl alcohol, 13% ethanol, 0.5% methanol and 19% water.

The use of a distilled product from fusel oil in gasoline has also been described (Karaosmanoglu 1996): Distillation of the fusel oil was performed to avoid adding additional water to the fuel mixture. Only the portion boiling above 120° C. was used.

A method of manufacturing a cetane improver from fusel oil has been described (U.S. Pat. No. 4,585,461) by mixing the fusel oil with a highly paraffinic hydrocarbon of specific properties, and nitrating the mixture with nitric and sulfuric acid.

To satisfy the increasing demand for cleaner-burning fuel from renewable sources, commercially acceptable, readily available and stable blends of ethanol with diesel fuel would be an attractive solution. To date the complexity of the current methods for making diesel fuel/ethanol blends, together with the economic constraints, have been barriers to the widespread development of such blends. Clearly, more economical and technically feasible solutions are needed in order for diesel fuel/ethanol blends to become as commonplace as gasoline/ethanol blends.

SUMMARY OF THE INVENTION

This invention is directed to a fuel composition comprising diesel fuel, a fusel oil distillate and ethanol.

The invention is also directed to a method of preparation of a fuel composition comprising the splash blending of a fusel oil distillate diesel fuel, and ethanol.

The invention is also directed to a method of using a product as a diesel fuel blending agent, said product obtained by the process of distillation of fusel oil and collection of the portion boiling from about 105° C. to about 125° C.

DETAILED DESCRIPTION OF THE INVENTION

An embodiment of the invention is directed to a fuel composition comprising from about 50% to about 95% diesel fuel, from about 5% to about 50% ethanol, and from 0.5% to about 6% fusel oil distillate.

A second embodiment of the invention is directed to a fuel composition comprising from about 75% to about 90% diesel fuel, from about 10% to about 20% ethanol, and from about 0.05% to about 5% fusel oil distillate.

A third embodiment of the invention is directed to a fuel composition comprising diesel fuel, a fusel oil distillate and ethanol, and further comprising less than 1.5% surface active agent.

A fourth embodiment of the invention is directed to a fuel composition comprising diesel fuel, a fusel oil distillate and ethanol, and further comprising less than 1.5% surface active agent and less than 5% water.

A fifth embodiment of the invention is directed to a fuel composition comprising diesel fuel, a fusel oil distillate and ethanol, wherein the fusel oil distillate is substantially free of water.

A sixth embodiment of the invention is directed to a fuel composition comprising diesel fuel, a fusel oil distillate and ethanol, wherein the fusel oil distillate is the portion obtained by the simple distillation of crude fusel oil that boils from about 105° C. to about 125° C.

A seventh embodiment of the invention is directed to a fuel composition comprising diesel fuel, a fusel oil distillate and ethanol, wherein the fusel oil distillate is the portion obtained by distillation of crude fusel oil that boils at a temperature from about 117° C. to about 125° C.

In an eighth embodiment, the invention is directed to a fuel composition comprising about 81.5% diesel fuel, about 16.3% ethanol and about 2.2% fusel oil distillate, wherein the fusel oil distillate is the portion obtained by distillation of crude fusel oil that boils at a temperature from about 117° C. to about 125° C.

In a ninth embodiment, the invention is directed to a method of using a product as a diesel fuel blending agent, said product obtained by the process of distillation of fusel oil and collection of the portion boiling from about 117° C. to about 125° C.

In a tenth embodiment, the invention is directed to a non-emulsified fuel composition comprising diesel fuel, a fusel oil distillate and ethanol.

In an eleventh embodiment, the invention is directed to a fuel composition comprising diesel fuel, ethanol and a fusel oil distillate which is monophasic from about −16° C. to about 50° C.

The diesel fuel may be any of the commonly used diesel fuel products commercially available, such as those referred to diesel no. 1 or diesel no. 2; biodiesel or petroleum-based diesel or biodiesel/petroleum diesel blends.

The ethanol may be denatured, absolute (anhydrous), or fuel ethanol, preferably denatured fuel ethanol containing no more than about 1% water.

Definitions

As used herein, the term "fusel oil" or "crude fusel oil" is a byproduct of the fermentation process of carbohydrate sources such as grains (corn, wheat, rice, etc.), sugars (sugar cane, molasses, sugar beet etc.) or starches (corn, potato etc.), which boils above that of the primary product of fermentation, ethanol. It can be characterized as an alcoholic mixture containing some water, with a boiling range from about 80° C. to about 132° C.

As used herein, the term "fusel oil distillate" refers to a portion of purified crude fusel oil, obtained by distillation to remove water. It may comprise sub portions characterized by the boiling range, e.g., from about 105° C. to about 125° C., or from about 117° C. to about 125° C., etc. Distillation techniques may be simple, or fractional, i.e., employ the use of a fractionating column or apparatus, such as a Normschliff Gerätebau fraction distillation unit.

As used herein, the term "ethanol" refers to ethyl alcohol, including 100% (absolute, anhydrous or dry) ethanol, an azeotrope containing from about 92% ethanol to about 96% ethanol and from about 8% water to about 4% water, or fuel ethanol which typically contains less than 1% water and is denatured typically with natural gasoline, gasoline components or unleaded gasoline. Other components for fuel grade ethanol are specified in ASTM D '4806.

The term "denatured alcohol", refers to ethanol to which an additional denaturing component is added to the ethyl alcohol in an amount from about 0.05% to about 5%. A denaturing component is a component which renders the ethanol unsuitable for human consumption, e.g., introduction of toxic or unpleasant properties.

As used herein the term "diesel fuel" is any diesel fuel which is suitable for use as a motor fuel. This includes, but is not limited to petroleum-based diesel fuel, vegetable or animal based diesel fuel ("biodiesel"), No. 1 diesel fuel and No. 2 diesel fuel and the like. The properties of each are defined; for example, the properties of No. 2 diesel fuel are defined by ASTM D975 specification.

As used herein the term "motor fuel" is any material acceptable by prevailing standards that can be used in an engine, including, but not limited to, internal combustion engines. Components of motor fuels include the basic combustible materials as well and other additives that are commonly used in formulations of fuels.

As used herein the term "diesel fuel blending agent" pertains to an agent that can be added to diesel fuel that provides enhanced properties of the resulting blend. Examples of such properties include improved homogeneity, viscosity index improvers, lowering of the cloud point, greater fuel efficiency, and the like.

As used herein, the term "vehicle" pertains to any motor vehicle operating overland, including but not limited to, automobiles, trains, trucks, tractors, motorcycles, all-terrain vehicles, golf carts and the like; aircraft, including propeller and jet-propelled airplanes, helicopters and the like; as well as water craft, including commercial vessels, sport boats, jet skis, underwater craft (submarines) and the like.

The internal combustion engines that can be fueled by the compositions described by this invention include any diesel-fueled engine that can be used to power or operate any device or equipment. Such devices or equipment include vehicles, heavy equipment including farm machinery, factory equipment, and construction equipment, portable tools such as chainsaws, compressors, lawn and garden equipment, electric generators and the like.

General Methods of Using the Invention

The compositions of the invention are blends of ethanol and diesel fuel which are homogeneous. Such blends can be used directly as a fuel for any diesel powered vehicle, device or equipment, in place of conventional diesel fuel. Preparation of the blend can be done either at the distribution site where fueling of the vehicle, device or equipment takes place, or at a location where bulk quantities of fuel are prepared, such as a refinery or fuel depot. Preparation of the compositions of the invention can be accomplished by splash blending, that is, by simple mixing of the diesel fuel, ethanol and fusel oil distillate prior to use. Once mixed, the blend may be used as is. While some agitation may be advantageous, the miscibility of the components of the blend does not require any special equipment to form the blend.

Precautions in the transportation, storage, and handling of the fuel blend are taken, similar to those taken for ethanol. For example, protection from water, humidity, extreme heat, sources of ignition such as flames, sparks and the like, is anticipated. These sorts of precautions are currently in place for the transportation, storage and handling of gasoline/ethanol blends.

The composition blends as described in this invention can be further optimized by addition of other components known to improve other properties related to phase stability, engine performance and emissions. Such component may be lubricants, cetane improvers, anti-corrosion additives and the like. Commercial acceptance of diesel fuel/ethanol blends is dependent upon achieving several of these practical standards. As reported by Golubkov et al., ("Alcohol-based diesel fuel for conventional engines—it is a reality", ISAF XV. In: The international Symposia on Alcohol fuels, San Diego; 2005), the feasibility of diesel fuel and ethanol blends has been demonstrated by continuous operational testing in busses in Sweden.

EXPERIMENTAL EXAMPLES

The invention is further illustrated in the following non-limiting examples.

General Experimental Procedures

Unless otherwise specified, industrial grade reagents are used for the examples described. The materials are mixed into 200 mL glass jars with screw lids and examined visually for impurities. If no apparent separation is observed, the jars are placed in cold storage overnight or longer, and then examined for phase separation and turbidity (cloudiness).

Example 1

Solutions containing 75 mL diesel fuel, 15 mL of 100% ethanol and from 1 to 5 mL of isoamyl alcohol are mixed and refrigerated for 96 h at −19° C. At the end of this time, the contents are examined and results shown in Table 1.

TABLE 1

| Materials, volume mL | | | Observation after |
|---|---|---|---|
| diesel fuel | 100% ethanol | isoamyl alcohol | 96 h at −19° C. |
| 75 | 15 | 1 | bilayered |
| 75 | 15 | 2 | bilayered |
| 75 | 15 | 3 | bilayered |
| 75 | 15 | 4 | monolayered |
| 75 | 15 | 5 | monolayered |

Example 2

Solutions containing 75 mL diesel fuel, 15 mL of 100% ethanol and 2, 4, 6, 8, and 10 mL of crude fusel are mixed and refrigerated for 24 hours at −8° C. At the end of this time, all samples are found to be bilayered.

Example 3

Crude fusel oil is slurried with anhydrous magnesium sulfate after which the solids are removed by filtration. The yield of dried fusel oil obtained is 18.3%.

Example 4

A sample of fusel oil initially containing 11.25% water is dried by standing for several days over molecular sieves designed for the removal of water, e.g., 3 Å molecular sieves. Blending experiments are conducted using the fusel oil thus obtained, using the procedure described in Example 2. All blended samples are found to be bilayered. The fusel oil sample is subjected to a longer drying period with additional molecular sieves. It is again tested in blending experiments as described in Example 2. The blended samples obtained are found to be bilayered.

Example 5

Crude fusel oil was slurried with calcium oxide, after which time the solids are removed by filtration. Substituting the crude fusel oil with the sample obtained in this example, blending experiments are conducted using the procedure described in Example 2. Blended mixtures containing 75 mL diesel fuel, 15 mL ethanol, and 5 mL or more of the fusel oil dried in this fashion are monolayered at temperatures as low as −8° C. At a temperature of −16° C., all blends became bilayered.

Example 6

Distillation of Fusel Oil

A 250 mL sample of crude fusel oil is simple distilled and the distillate separated into four portions. The first portion is biphasic, with a total of volume of 62.5 mL, and boils from 88.5-89° C. The bottom phase (lower layer) of this portion has a volume of 11 mL. The second portion is collected at 89° C. and has a total volume of 17 mL. This portion is also biphasic. The bottom layer has a volume of 1 mL. The third portion is collected at 105-117° C., is monophasic, and has a total volume of 17 mL. The fourth and final portion is collected at 117-125° C., is monophasic, and has a total volme of 130 mL.

Portions 1 and 2 are discarded. Portions 3 and 4 are combined in a proportion of 17:130 so as to give a fusel oil distillate equivalent to the uncut fractions collected from 105-125° C. This combined fusel oil distillate and remaining fraction 4 are used in the experiments listed below in Examples 7 and 8, respectively.

Example 7

Blends of diesel fuel, 100% ethanol and the combined distilled fusel oil portions 3 and 4 as described in Example 6 above are prepared and their characteristics observed. The results are shown in Table 2.

TABLE 2

| Entry Number | Mixture | Appearance at Room Temperature | Appearance After 24 h at −16° C. |
|---|---|---|---|
| 1 | 75 mL diesel fuel<br>15 mL 100% ethanol<br>1 mL distilled fusel oil[1] | Monolayered | Bilayered |
| 2 | 75 mL diesel fuel<br>15 mL 100% ethanol<br>1.5 mL distilled fusel oil[1] | Monolayered | Bilayered |
| 3 | 75 mL diesel fuel<br>15 mL 100% ethanol<br>2 mL distilled fusel oil[1] | Monolayered | Monolayered |
| 4 | 75 mL diesel fuel<br>15 mL 100% ethanol<br>3 mL distilled fusel oil[1] | Monolayered | Monolayered |
| 5 | 75 mL diesel fuel<br>15 mL 100% ethanol<br>4 mL distilled fusel oil[1] | Monolayered | Monolayered |
| 6 | 75 mL diesel fuel<br>15 mL 100% ethanol<br>5 mL distilled fusel oil[1] | Monolayered | Monolayered |

([1]From Example 6, portions 3 and 4)

Example 8

The blends as listed in Example 7 are prepared but using the remaining portion 4, Example 6 as the fusel oil distillate, in place of the combined portions 3 and 4, Example 6. The identical observations are made for the blends so obtained.

While the invention has been described with reference to particularly preferred embodiments and examples, those skilled in the art recognize that various modifications may be made to the invention without departing from the spirit and scope thereof.

All of the above U.S. patents, U.S. patent application publications, U.S. patent applications, foreign patents, foreign patent applications and non-patent publications referred to in this specification and/or listed in the Application Data Sheet are incorporated herein by reference, in their entirety.

ABBREVIATIONS AND ACRONYMS

In the foregoing sections, a number of abbreviations and acronyms were used, and the full description of these is provided as follows:

Btu British thermal unit
mL milliliter
h hour(s)
min minute(s)
v/v volume/volume

What is claimed is:

1. A fuel composition comprising diesel fuel, a fusel oil distillate and ethanol, wherein said fusel oil distillate is obtained by the process of distillation of crude fusel oil and collection of the portion boiling at a temperature from about 105° C., to about 125° C.

2. A fuel composition according to claim 1 comprising from about 50% to about 95% diesel fuel, from about 5% to about 50% ethanol, and from about 0.5% to about 6% fusel oil distillate.

3. A fuel composition according to claim 1 comprising from about 75% to about 90% diesel fuel, from about 10% to about 20% ethanol, and from about 0.05% to about 5% fusel oil distillate.

4. A fuel composition according to claim 3, further comprising less than 1.5% surface active agent.

5. A fuel composition according to claim 4, further comprising less than 5% water.

6. A fuel composition according to claim 1, further comprising less than 1% water.

7. A composition according to claim 1 wherein the fusel oil distillate is the portion obtained by distillation of crude fusel oil that boils at a temperature from about 117° C., to about 125° C.

8. A fuel composition comprising about 81.5% diesel fuel, about 16.3% ethanol and about 2.2% fusel oil distillate, wherein the fusel oil distillate is the portion obtained by distillation of crude fusel oil that boils at a temperature from about 117° C., to about 125° C.

9. A method of preparation of a fuel composition, comprising the splash blending of a fusel oil distillate with a mixture of diesel fuel and ethanol, wherein said fusel oil distillate is obtained by the process of distillation of crude fusel oil and collection of the portion boiling at a temperature from about 105° C., to about 125° C.

10. A method of using a product as a diesel fuel blending agent, said product obtained by the process of distillation of fusel oil and collection of the portion boiling from about 105° C. to about 125° C., said method comprising the blending of diesel fuel and ethanol with said product to produce a miscible composition.

11. A method of using a product as a diesel fuel blending agent, said product obtained by the process of distillation of fusel oil and collection of the portion boiling from about 117° C., to about 125° C., said method comprising the blending of diesel fuel and ethanol with said product to produce a miscible composition.

12. A non-emulsified fuel composition comprising diesel fuel, a fusel oil distillate and ethanol, wherein said fusel oil distillate is obtained by the process of distillation of crude fusel oil and collection of the portion boiling at a temperature from about 105° C., to about 125° C.

13. A fuel composition comprising diesel fuel, ethanol and a fusel oil distillate, wherein said fusel oil distillate is obtained by the process of distillation of crude fusel oil and collection of the portion boiling at a temperature from about 105° C., to about 125° C., and wherein said composition is monophasic from about −16° C., to about 50° C.

14. A fuel composition according to claim 1 consisting essentially of diesel fuel, a fusel oil distillate and ethanol, wherein said fusel oil distillate is obtained by the process of distillation of crude fusel oil and collection of the portion boiling at a temperature from about 105° C., to about 125° C.

15. A fuel composition according to claim 1 consisting essentially of diesel fuel, a fusel oil distillate and ethanol, wherein said fusel oil distillate is obtained by the process of distillation of crude fusel oil and collection of the portion boiling at a temperature from about 117° C., to about 125° C.

16. A fuel composition according to claim 15 consisting essentially of from about 50% to about 95% diesel fuel, from about 5% to about 50% ethanol, and from about 0.5% to about 6% fusel oil distillate.

17. A fuel composition according to claim 15 consisting essentially of from about 75% to about 90% diesel fuel, from about 10% to about 20% ethanol, and from about 0.05% to about 5% fusel oil distillate.

* * * * *